US007819049B2

(12) United States Patent
Pastrnak et al.

(10) Patent No.: US 7,819,049 B2
(45) Date of Patent: Oct. 26, 2010

(54) PORTABLE CONVERTIBLE BLAST EFFECTS SHIELD

(75) Inventors: John W. Pastrnak, Livermore, CA (US); Rocky Hollaway, Modesto, CA (US); Carl D. Henning, Livermore, CA (US); Steve Deteresa, Livermore, CA (US); Walter Grundler, Hayward, CA (US); Lisle B. Hagler, Berkeley, CA (US); Edwin Kokko, Dublin, CA (US); Vernon A Switzer, Livermore, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 0 days.

(21) Appl. No.: 11/731,420

(22) Filed: Mar. 30, 2007

(65) Prior Publication Data

US 2008/0121100 A1 May 29, 2008

Related U.S. Application Data

(63) Continuation of application No. 10/817,107, filed on Apr. 2, 2004, now Pat. No. 7,219,588.

(60) Provisional application No. 60/460,176, filed on Apr. 2, 2003.

(51) Int. Cl.
*F41H 5/14* (2006.01)

(52) U.S. Cl. ..... 89/36.09; 86/50

(58) Field of Classification Search ..... 86/50; 89/36.07, 36.09

See application file for complete search history.

(56) References Cited

U.S. PATENT DOCUMENTS

| | | | | | |
|---|---|---|---|---|---|
| 544,338 | A * | 8/1895 | Wilson | 105/394 |
| 1,274,721 | A * | 8/1918 | Krzan | 89/40.03 |
| 1,297,455 | A * | 3/1919 | Fimiani | 109/49.5 |
| 3,329,298 | A * | 7/1967 | Demas | 220/8 |
| 4,032,240 | A * | 6/1977 | Reinhardt et al. | 403/108 |
| 4,748,064 | A * | 5/1988 | Harpell et al. | 428/113 |
| 5,425,973 | A * | 6/1995 | Frangipane et al. | 428/35.7 |
| 6,196,647 | B1 * | 3/2001 | Kupferschmid | 312/9.48 |

OTHER PUBLICATIONS

Disrupter Ring; Explosive and/or Volatile Transport Systems; Apr. 2, 2004.*

* cited by examiner

*Primary Examiner*—Stephen M Johnson
(74) *Attorney, Agent, or Firm*—James S. Tak

(57) ABSTRACT

A rapidly deployable portable convertible blast effects shield/ballistic shield includes a set two or more telescoping cylindrical rings operably connected to each other to convert between a telescopically-collapsed configuration for storage and transport, and a telescopically-extended upright configuration forming an expanded inner volume. In a first embodiment, the upright configuration provides blast effects shielding, such as against blast pressures, shrapnel, and/or fire balls. And in a second embodiment, the upright configuration provides ballistic shielding, such as against incoming weapons fire, shrapnel, etc. Each ring has a high-strength material construction, such as a composite fiber and matrix material, capable of substantially inhibiting blast effects and impinging projectiles from passing through the shield. And the set of rings are releasably securable to each other in the telescopically-extended upright configuration, such as by click locks.

10 Claims, 6 Drawing Sheets

PORTABLE CONVERTIBLE BLAST EFFECTS SHIELD

I. REFERENCE TO PRIOR APPLICATIONS

This application is a continuation of prior application Ser. No. 10/817,107 filed Apr. 2, 2004, now U.S. Pat. No. 7,219,588, which claims the benefit of Provisional Application No. 60/460,176 filed on Apr. 2, 2003, entitled "Rapid Deployment Blast Effects Shield (BES) Confinement System", by John W. Pastrnak, and incorporated by reference herein. Any disclaimer that may have occurred during the prosecution of the above-referenced application Ser. No. 10/817,107 is hereby expressly rescinded.

The United States Government has rights in this invention pursuant to Contract No. W-7405-ENG48 between the United States Department of Energy and the University of California for the operation of Lawrence Livermore National Laboratory.

II. FIELD OF THE INVENTION

The present invention relates to apparatuses and methods which provide ballistic shielding. The invention relates more particularly to a portable convertible blast effects/ballistic shield having a rapidly deployable arrangement of telescoping rings for shielding against blast effects, such as shrapnel, blast pressure, and/or fireball from an explosive, or for shielding users from incoming weapons fire.

III. BACKGROUND OF THE INVENTION

The dangers of bombs, explosive devices, and articles of unknown origin suspected to be an explosive device, are well known, especially when discovered placed in common areas of public facilities, such as airports, train stations, building lobbies, etc. To address such threats, emergency response teams have been known to utilize aqueous foam as a blast mitigator. Such foams, however, provide little protection from fragmentation/shrapnel and other exploding projectiles. Bomb squad professionals have also used large heavy steel tanks mounted on trailers that are towed as close as possible to where the bomb is found. This placement operation, however, often requires the trailers to be brought from an offsite location which may be delayed due to traffic, traffic conditions, and other variables.

Cylindrical rings have also been utilized for placement over and around a suspected explosive device or object to protect against horizontal blast effects and fragments. One example known as a "disruptor ring" is produced by Protection Development International Corporation (PDIC) of Corona Calif., (http://www.armor-pdi.com). The disruptor ring has a unibody cylindrical ring construction with a slot on its sidewall through which a disruptor is placed for destroying the unknown article. Handles are also connected to the cylindrical ring for carrying/physically transporting the ring to an incident location.

Similar to the threat of blast effects and exploding fragments, the dangers of incoming weapons fire are also well appreciated. Oftentimes, it is necessary for military, law enforcement, or security personnel, to enter or pass through known "hot" zones of incoming weapons fire, such as for example in rescue operations of downed personnel or to capture a strategic location in the midst of a firefight. In such situations, user mobility under fire is critical, and for which individual safety is often sacrificed. While bullet-proof vests and other body-clad armor or protective devices are known and are capable of defeating some types of small arms fire, they often do not provide complete body shielding.

In both situations of blast effects mitigation and personal shielding against weapons fire, the need to provide rapidly-deployable interim protection to individuals, both directly and indirectly, is compelling and widely recognized. It would therefore be advantageous to provide a simple, cost-effective, easily storable, and rapidly-deployable blast effects/ballistic shield which is readily available for easy set up and deployment, to minimize interim risk from terrorist or other explosive devices at public facilities, as well as provide improved personal protection from exposure against weapons fire.

IV. SUMMARY OF THE INVENTION

One aspect of the present invention includes a portable convertible blast effects shield comprising: a set of at least two telescoping cylindrical rings having a high-strength material construction capable of substantially inhibiting blast effects from passing therethrough, said set of rings operably connected to each other to convert between a telescopically-collapsed configuration for storage and transport, and a telescopically-extended upright configuration forming an expanded inner volume for walling therein a suspected explosive object to shield against lateral blast effects potentially generated from within the expanded inner volume; and means for releasably securing said set of rings in the telescopically-extended upright configuration.

Another aspect of the present invention includes a portable convertible blast effects shielding system comprising: a first set of at least two telescoping cylindrical rings operably connected to each other to convert between a telescopically-collapsed configuration for storage and transport, and a telescopically-extended upright configuration forming an expanded inner volume for walling therein a suspected explosive object and providing lateral shielding against blast effects potentially generated from within the expanded inner volume; a second set of at least two telescoping cylindrical rings telescopically surrounding the first set of rings to form an annular gap region therebetween, said second set of rings operably connected to each other to convert between a telescopically-collapsed configuration for storage and transport, and a telescopically-extended upright configuration for providing supplemental lateral shielding against blast effects potentially generated from within the expanded inner volume; wherein the rings of said first and second set have a high-strength material construction capable of substantially inhibiting blast effects from passing therethrough; and means for releasably securing said first and second set of rings in the telescopically-extended upright configuration.

And another aspect of the present invention includes a portable convertible ballistic shield for providing protected user mobility under weapons fire comprising: a set of at least two telescoping cylindrical rings having a high-strength, low-density composite fiber and matrix material construction capable of substantially inhibiting impinging projectiles, blast effects, and shrapnel from passing therethrough, said set of rings operably connected to each other to convert between a telescopically-collapsed configuration for storage and transport, and a telescopically-extended upright configuration forming an expanded inner volume capable of accommodating at least one operator therein for shielding the operator from laterally incoming projectiles, blast effects, and shrapnel; means for releasably securing said set of rings in the telescopically-extended upright configuration; and means for wheeling said portable ballistic shield while deployed in the telescopically-extended upright configuration, including at least three rolling surfaces extending below the deployed shield.

And another aspect of the present invention includes a portable convertible blast effects shield comprising: a standalone set of at least two telescoping cylindrical rings capable of substantially inhibiting blast effects from passing therethrough, said set of rings operably connected to each other to convert between a telescopically-collapsed configuration, and a telescopically-extended upright configuration forming an expanded inner volume and open at opposite ends thereof; and means for releaseably securing said set of rings to each other in the telescopically-extended upright configuration.

And another aspect of the present invention includes a portable convertible ballistic shield for providing protected user mobility under weapons fire comprising: a standalone set of at least two telescoping cylindrical rings capable of substantially inhibiting blast effects from passing therethrough, said set of rings operably connected to each other to convert between a telescopically-collapsed configuration, and a telescopically-extended upright configuration forming an expanded inner volume and open at opposite ends thereof; means for releaseably securing said set of rings to each other in the telescopically-extended upright configuration; and wheel means connected to said portable ballistic shield for enabling said operator(s) to wheel said portable ballistic shield from inside the telescopically-extended upright configuration, said wheel means including at least three rolling surfaces extending below the deployed shield.

V. BRIEF DESCRIPTION OF THE DRAWINGS

The accompanying drawings, which are incorporated into and form a part of the disclosure, are as follows.

VI. DETAILED DESCRIPTION

The present invention is directed to a low cost, highly portable, lightweight, and convertible blast effects shield/ballistic shield which operates to substantially reduce the effects of blast effects and/or projectiles impinging thereon by substantially inhibiting the blast effects and/or impinging particles from passing therethrough. When utilized as a blast effects shield, the apparatus is capable of being positioned to surround terrorist/bomb/explosive devices, or objects suspected as such, to provide immediate interim protection while the bomb squad is in route. In this manner, the risk of blast effects from the bomb/device are reduced if the bomb detonated before trained emergency response and/or bomb squad personnel had an opportunity to disable the threat. "Blast effects" include blast pressure (air shocks), fragmentation effects including projectiles such as shrapnel, and/or fireball. Furthermore, the present invention may also be utilized as a portable convertible ballistic shield to provide protected user mobility under weapons fire. In either case, the shield has a simplified convertible construction which enables portability and easy deployment. Moreover, the simplified construction enables cost-effectiveness of manufacture for widespread use, such that airports and other public facilities; for example, may have one or more units available onsite for quick access and use. Law enforcement/security personnel would be trained to know of its existence and storage location, for quick deployment during a bomb scare evacuation, and thereby minimize the risk of blast injury.

Figure 1:
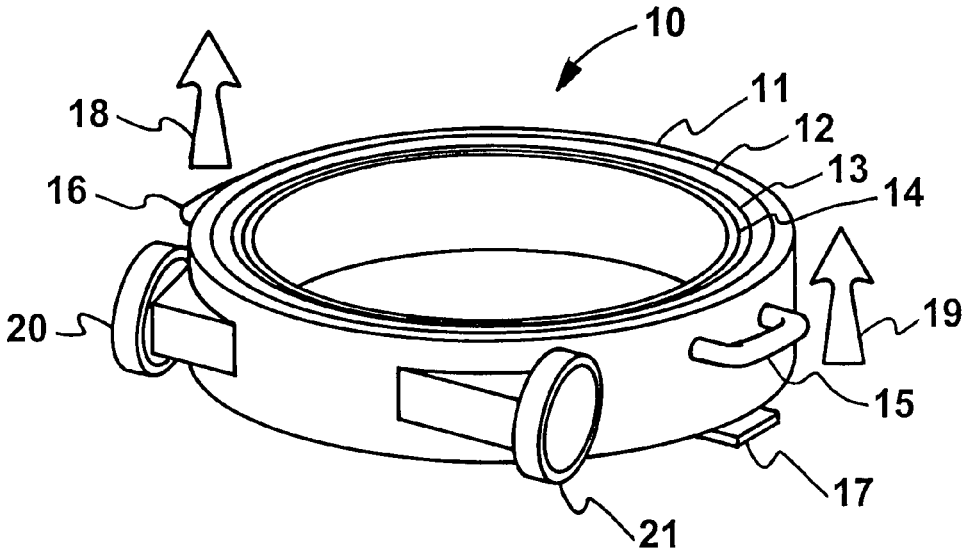
FIG. 1 is a perspective view of an exemplary embodiment of the present invention as a portable convertible blast shield shown in a telescopically-collapsed configuration.
Figure 2:
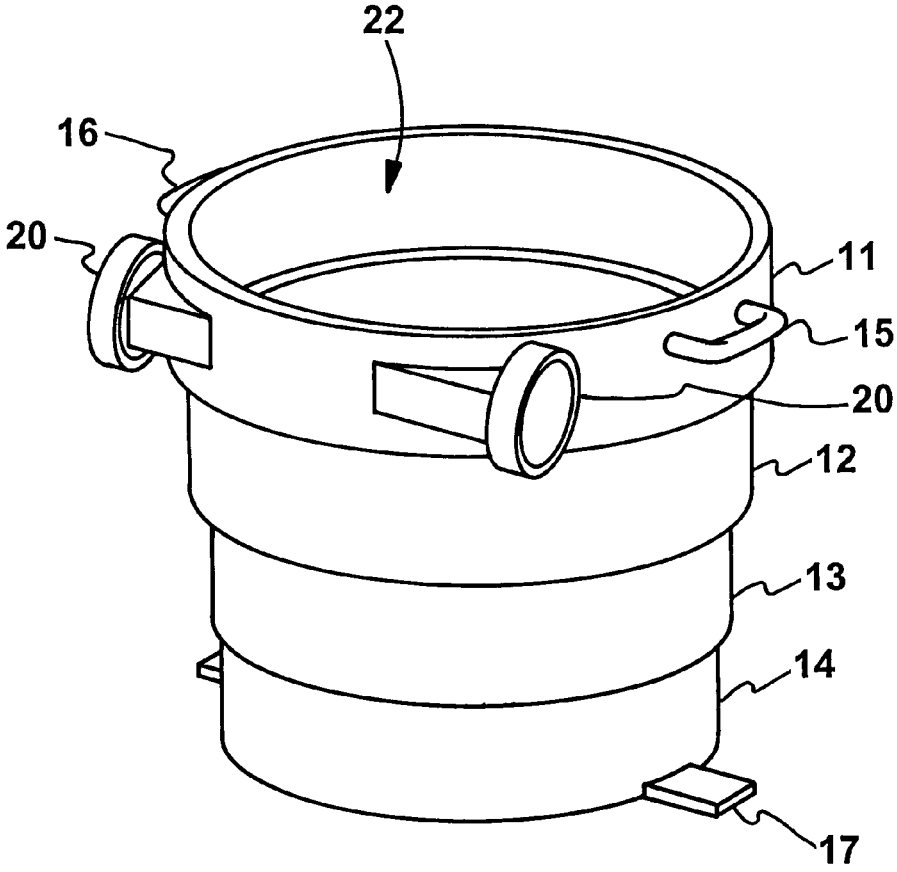
FIG. 2 is a perspective view of the portable convertible blast shield of FIG. 1 in a telescopically-extended upright configuration.

Turning now to the drawings, FIGS. 1 and 2, show a first exemplary embodiment of the portable convertible blast effects shield, generally indicated at reference character 10. Generally, the shield includes a set of at least two telescoping cylindrical rings, and preferably a plurality of such rings. In FIGS. 1 and 2 the shield 10 is shown having four rings, 11-14, including an outer ring 11 and an inner ring 14. The diameters of the cylindrical rings are suitably dimensioned, e.g. approximately 2 meters, such that the inner ring 14 is capable of surrounding a relative small object, typically having the size and dimensions of articles often associated with terrorist bombs/explosive devices, such as a briefcase, or other types of luggage and/or bags. And the height of the ring provides the necessary surface area which enables the sidewall of the ring to provide shielding. The heights of the cylindrical rings are also suitably dimensioned to achieve, when extended to a telescopically-extended upright position (see below), a sufficient combined shield height to protect against laterally directed blast effects/projectiles. A plurality of telescoping rings may be utilized for this purpose. The cylindrical rings are characterized as such because the diameter of each ring is substantially greater than its height.

Each cylindrical ring of the shield is constructed from a high-strength material capable of inhibiting the passage of blast effects/impinging projectiles therethrough. Preferably the material is a low-density, high strength composite fiber and matrix material, with the fiber being a filament-wound fiber. Low density material construction allows investigative radiography through the walls of the blast shield so that bomb squad personnel may assess the suspected explosive device in relative safety after confining the device within the blast shield. Various types of fiber may be utilized, include but is not limited to, Spectra fiber, Kevlar fiber, or PBO fiber among others. Additionally, a ceramic material lining may be provided on each of the cylindrical rings to provide supplemental ballistic shielding and protection. Various types of ceramics may be utilized for this purpose, and may be lined on an inner surface of the rings, or an outer surface of the rings.

With this arrangement, the shield 10 may be converted from a telescopically-collapsed configuration, shown in FIG. 1, and a telescopically-extended upright configuration, shown in FIG. 2. While in storage or during transport, the shield 10 is preferably in the telescopically-collapsed configuration for compactness and ease of handling. When deployed to surround a suspected explosive threat; however, the shield is converted into the telescopically-extended configuration to provide blast effects shielding.

To facilitate the conversion of the shield between these two configurations, one or more handle(s) may be provided which are operably associated with one of the inner ring 14 or the outer ring 11, i.e. the "handle-associated ring." As shown in FIGS. 1 and 2, the outer ring 11 is the handle-associated ring, with handles 15 and 16 connected thereto. The handles 15 and 16 may be lifted upwards, as indicated by arrows 18 and 19, to convert the shield from the collapsed configuration of FIG. 1 to the extended upright configuration of FIG. 2. The handles are preferably evenly spaced around the handle-associated ring to facilitate telescopic operation thereof by an operator when raising and lowering the handle-associated ring between a base position (FIG. 1) and an elevated position (FIG. 2). It is appreciated that the handles may also be utilized to manually lift, and transport, the shield in addition to enabling shield convertibility. In addition to handles, one or more foot-hold(s) may be provided which are operably associated with the other one of the inner ring 14 or the outer ring 11, i.e. the "foot-hold-associated ring," not chosen as the handle associated ring. In FIGS. 1 and 2, foot-hold 17 is shown connected to inner ring 14, i.e. the foot-hold associated ring, such that a user may step on the foot-hold 17 to maintain the position of the foot-hold associated ring 14 when the handle-associated ring 11 is raised to the elevated position.

Figure 3:
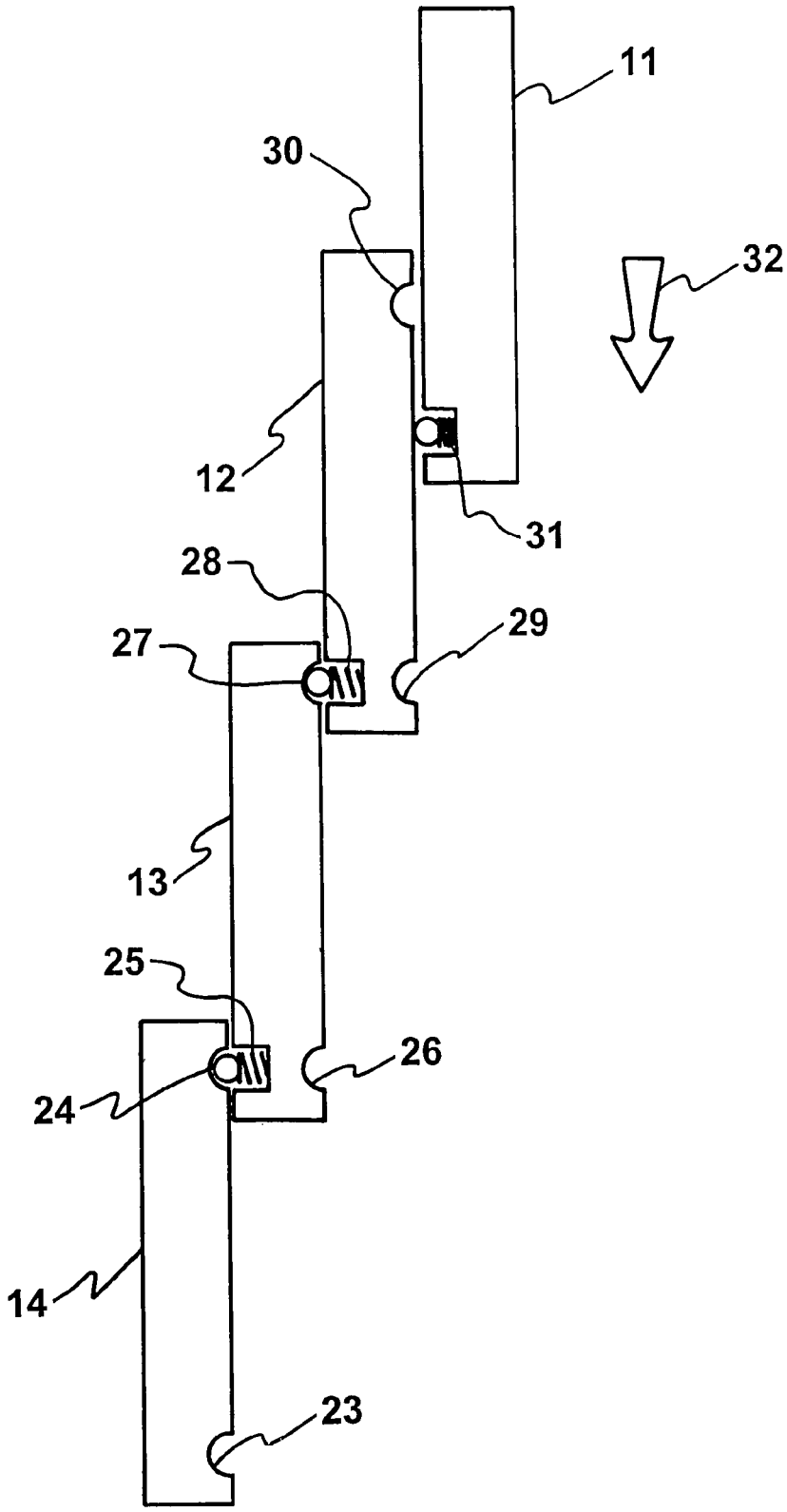
FIG. 3 is a cross-sectional view of an exemplary click-lock mechanism for releasably securing the cylindrical rings in the telescopically-collapsed configuration as well as the telescopically-extended upright configuration.

When converted into the telescopically-extended upright configuration, the shield 10 is releasably securable in that configuration by suitable means/mechanism provided between the rings. Such a mechanism releasably catches an adjacent ring when slidably operated between the two configurations. One exemplary embodiment of such a mechanism is a click-lock arrangement, such as the detent mechanism shown in FIG. 3, but is not limited only to such. FIG. 3 illustrates the click-locking arrangement as utilized between the four rings 11-14, and generally shown in the telescopically-extended upright configuration. Rings 12-14 are shown each having an upper detent groove 30, 27, and 24, respectively. And rings 11-13 are each shown having a lower detent 31, 28, and 25, respectively, facing the detent grooves 30, 27, 24. When pulled up from a base position to an elevated position of the telescopically-extended upright configuration, the detent 31 on the handle-associated ring 11 would mate with its associated upper detent groove 30 in the adjacent ring 12, and pull up on the adjacent ring 12 which in turn repeat the detent mating and pulling until all rings not-including the foot-hold associated ring 14, is telescopically extended.

The reverse would hold true when converting the rings back into the collapsed configuration. As shown in FIG. 3 by arrow 32, by pushing down on outer ring 11, the detent 31 slips out of detent groove 30 until all detents are similarly slipped out of the upper detent grooves to enable the rings to again realign. To facilitate the collapsing operation, FIG. 3 is shown provided with lower detent grooves 23, 26, and 29 on rings 14, 13, and 12, respectively. By mating the detents with the lower detent grooves, the force exerted on the handle-associated ring may be transferred through and to each of the other rings. It is appreciated that the use of lower detent grooves may also serve to secure the rings while in the collapsed configuration so as to keep the rings secured together during storage and transport. However, other means, such as tie-downs or other releasably securing means may be used in the alternative to releasably secure the rings in the telescopically-collapsed configuration. As used in FIG. 3, the click-lock devices are utilized in a bi-stable arrangement for releasably securing the rings in both the telescopically-extended upright configuration and the telescopically collapsed configuration. While the detent type click-locks are one example, other types of click-lock and non-click lock devices may also be used in the alternative which enable the rings to be releasably be secured in the telescopically-extended upright configuration.

The shield may also be provided with wheels or other means for wheeling the shield to an incident location. This may include wheels, rollers, casters, or other types of rolling surfaces. As shown in FIG. 1, two wheels 20 and 21 are provided in a dolly or handtruck arrangement. The connection of the two wheels 20, 21 is such that a rotational axis of the wheels are substantially tangent to the outer ring 11. This enables the shield to be dollied on two wheels while in the telescopically collapsed configuration.

Figure 4:
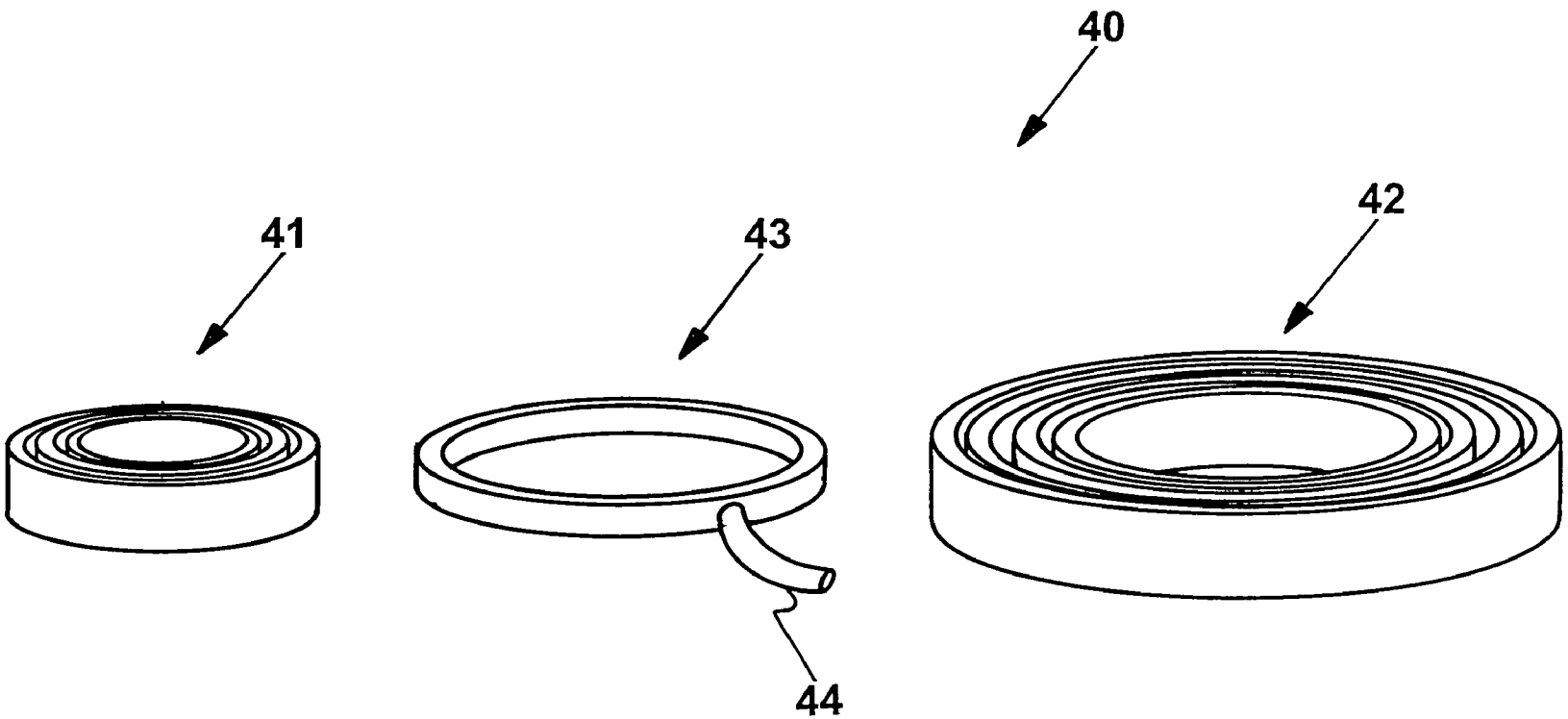
FIG. 4 is a perspective exploded view of a second exemplary embodiment of the present invention as a portable convertible blast shielding system.
Figure 5:
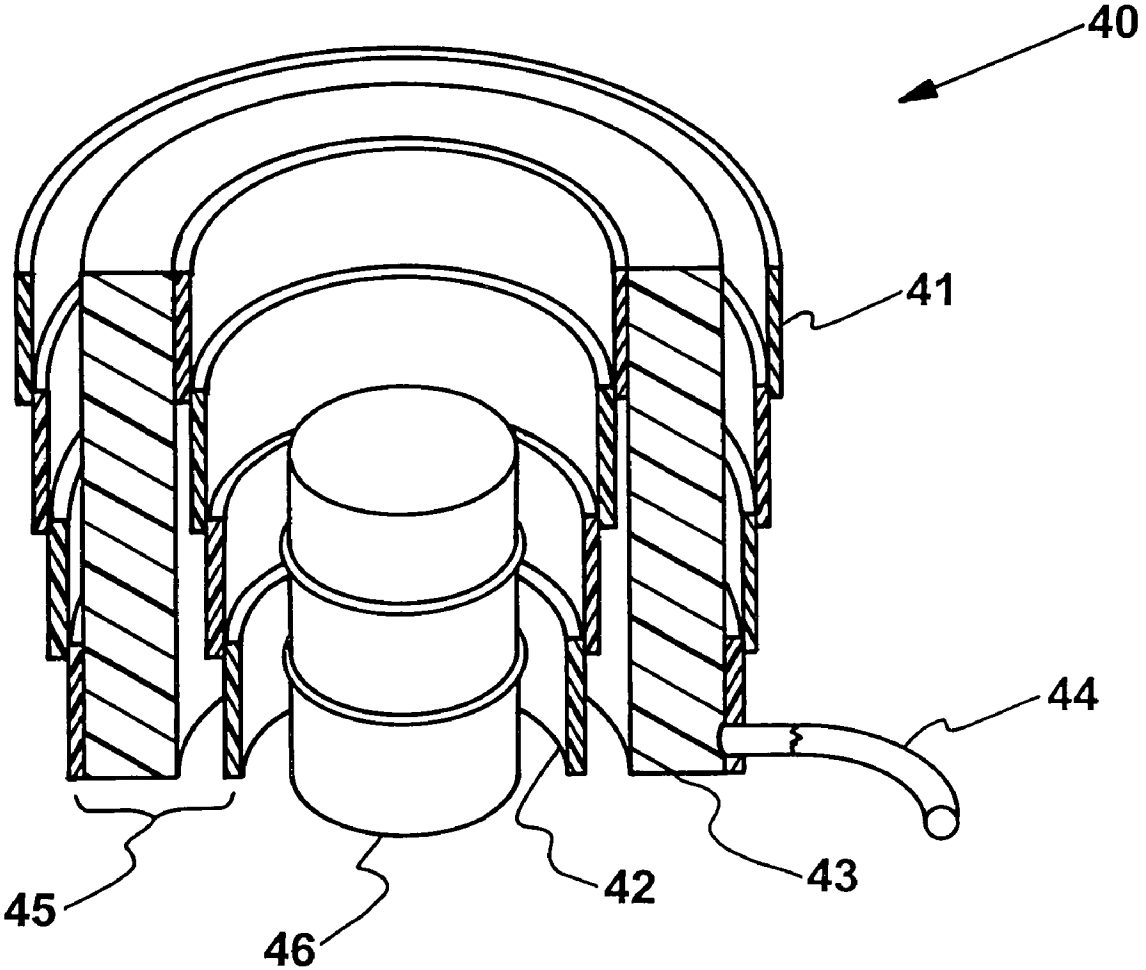
FIG. 5 is a perspective view of the second exemplary embodiment of FIG. 4 assembled and surrounding a bomb.

FIGS. 4 and 5, show a second system embodiment of the present invention utilizing two sets of rings for shielding against blast effects. FIG. 4 shows each of the components of the shielding system, generally indicated at 40. The shielding system includes a first set of telescoping cylindrical rings 41 operably connected to each other in the manner described above. A second set of telescoping cylindrical rings 42 is also provided also operably connected to each other in the manner described above. The second set of rings 42 has a greater diameter than the first set 41 such that an annular gap region 45 (FIG. 5) is formed therebetween. The first and second sets of rings 41, 42 may be independently convertible between the telescopically-collapsed configuration and the telescopically-extended upright configuration. To this end, the two sets of rings may be constructed as a single unit, or have a modular construction, as shown in FIG. 4, wherein the two sets of rings are capable of separation, and independent storage, transport, and deployment. Or in the alternative, the two sets of rings may be operably connected, such that they may be simultaneously converted between the telescopically-collapsed configuration and the telescopically-extended upright configuration.

Furthermore, as show in FIGS. 4 and 5, the shielding system 40 may also include a bladder 43 capable of being filled with a blast-mitigating material like water or foam. The bladder 43 is adapted to be positioned in the annular gap region 45 to provide additional blast effects shielding, and includes a hose 44 or other conduit by which the bladder 43 may be remotely filled. In an exemplary embodiment, the bladder 43 is adapted to remotely raise the telescoping cylindrical rings of both sets to the telescopically-extended upright configuration when filled. This is accomplished by configuring the bladder to internally exert opposing forces between the foot-hold associated rings of the two sets, and the holder-associated rings of the two sets during its expansion when filled, such as through the hose 44. Or in the alternative, the two sets of rings 41, 42 may be configured to operate without the bladder, and rather adapted to receive a shrapnel mitigating solid material like soil or sand in the gap therebetween.

Figure 6:
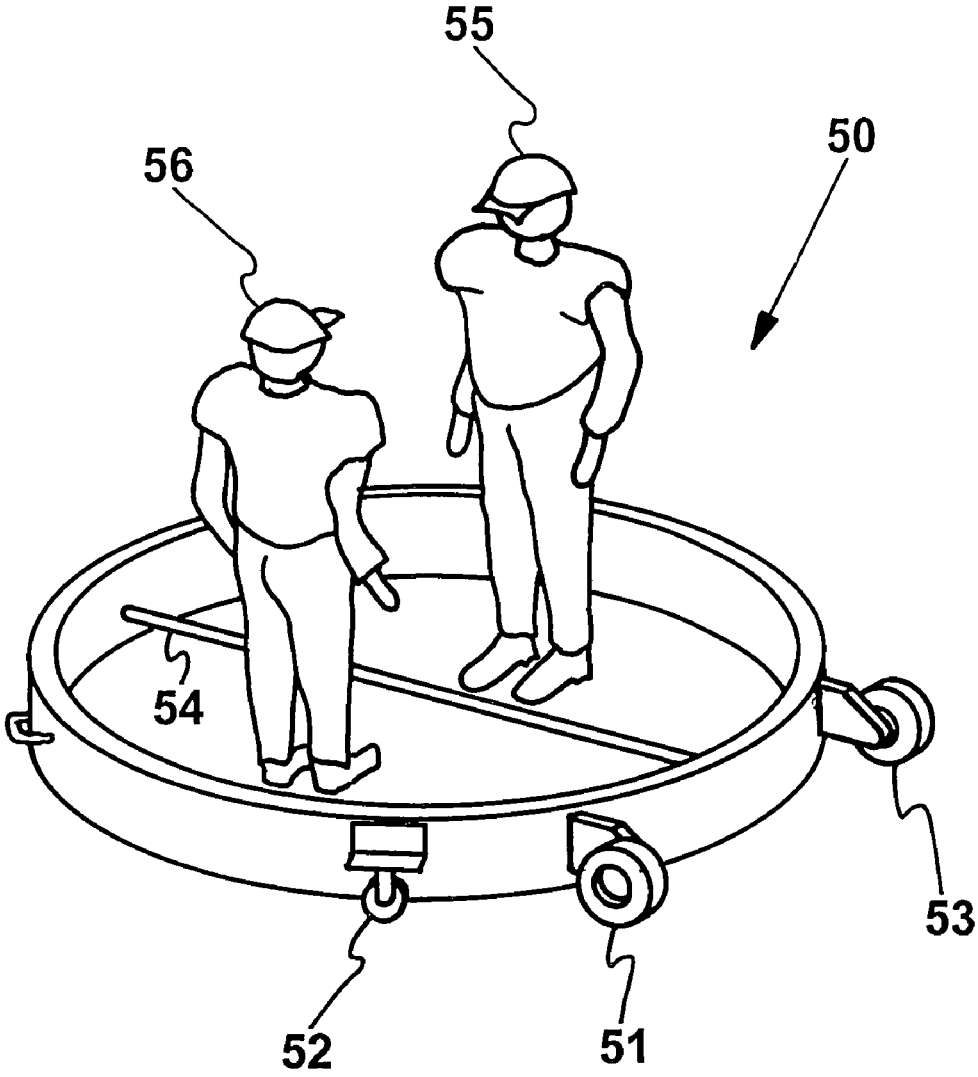
FIG. 6 is a perspective view of a third exemplary embodiment of the present invention as a portable convertible ballistic shield shown in a telescopically-collapsed configuration.
Figure 7:
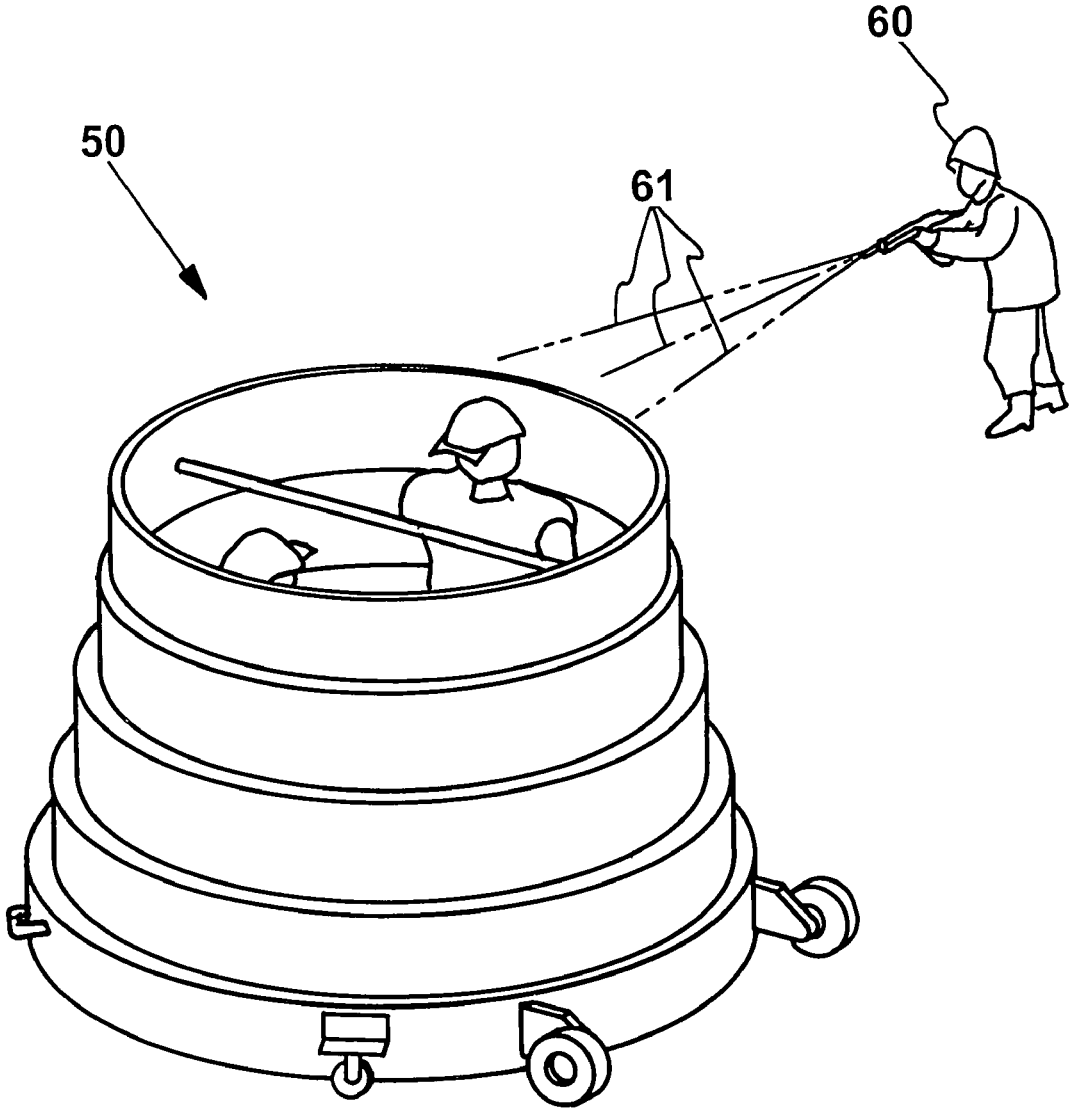
FIG. 7 is a perspective view of the third exemplary embodiment of FIG. 6 shown in a telescopically-extended upright configuration.

FIGS. 6 and 7 show a third exemplary embodiment of the present invention utilized as a portable convertible ballistic shield 50 to provide user mobility under fire. The ballistic shield has a similar telescopic arrangement of cylindrical rings as described previously for the portable convertible blast effects shield. As shown in FIG. 6, however, a handle such as bar 54 is preferably located within the perimeter defined by the rings, such that a user may operate the shield from therewithin. By stepping into the center of the rings and raising the bar 54 the shield may be raised to the telescopically-extended configuration of FIG. 7, and provide protection to operators, such as 56 and 57, from weapons fire, as indicated by arrows 61 from enemy source 60. The shield 50 is dimensioned to accommodate one or more user operators when utilized as a portable ballistic shield for weapons fire cover. Additionally, as shown in FIG. 6, at least three rolling surfaces, such as wheels 51-53, are provided extending below the shield while deployed in the telescopically-extended upright configuration, so as to provide a means for wheeling the ballistic shield while deployed in the upright configuration.

While particular operational sequences, materials, temperatures, parameters, and particular embodiments have been described and or illustrated, such are not intended to be limiting. Modifications and changes may become apparent to those skilled in the art, and it is intended that the invention be limited only by the scope of the appended claims.

We claim:

1. A portable convertible blast effects shield comprising:

a freestanding set of at least two telescoping cylindrical rings constructed of a composite fiber and matrix material to substantially inhibit blast effects from passing therethrough, said set of rings operably connected to each other to convert between a telescopically-collapsed configuration, and a telescopically-extended upright configuration forming an expanded inner volume and open at opposite ends thereof so that through one of the open ends the freestanding set of rings may be directly placed over and around an object or person to be shielded; and means for releaseably securing said set of rings to each other in the telescopically-extended upright configuration.

2. The portable convertible blast effects shield of claim 1, wherein the fiber used in said composite fiber and matrix material is a filament-wound fiber.

3. The portable convertible blast effects shield of claim 1, further comprising:

at least one handle operably associated with one of an innermost one of said rings and an outermost one of said rings for actuation thereof between a base position when in the telescopically-collapsed configuration and an elevated position when in the telescopically-extended upright configuration.

4. The portable convertible blast effects shield of claim 3, wherein a plurality of handles are operably associated with one of the innermost ring and the outermost ring.

5. The portable convertible blast effects shield of claim 3, further comprising:

at least one foot-hold operably associated with the other one of the innermost and outermost rings for maintaining the position thereof when the ring associated with the at least one handle is raised to the elevated position.

6. The portable convertible blast effects shield of claim 1, wherein said means for releasably securing said set of rings in the telescopically-extended upright configuration comprises a plurality of click-lock devices between said rings.

7. A portable convertible blast effects shield comprising:

a freestanding set of at least two telescoping cylindrical rings constructed of a composite fiber and matrix material to substantially inhibit blast effects from passing therethrough, said set of rings operably connected to each other to convert between a telescopically-collapsed configuration, and a telescopically-extended upright configuration forming an expanded inner volume and open at opposite ends thereof so that through one of the open ends the freestanding set of rings may be directly placed over and around an object or person to be shielded;

means for releaseably securing said set of rings to each other in the telescopically-extended upright configuration; and a pair of wheels rotatably connected to an outer ring for dollying said portable convertible blast effects shield in the telescopically-collapsed configuration.

8. A portable convertible blast effects shield comprising:

a freestanding set of at least two telescoping cylindrical rings constructed of a composite fiber and matrix material to substantially inhibit blast effects from passing therethrough, said set of rings operably connected to each other to convert between a telescopically-collapsed configuration, and a telescopically-extended upright configuration forming an expanded inner volume and open at opposite ends thereof so that through one of the open ends the freestanding set of rings may be directly placed over and around an object or person to be shielded;

means for releaseably securing said set of rings to each other in the telescopically-extended upright configuration; and means for releasably securing said set of rings in the telescopically-collapsed configuration to keep said rings together during storage and transport.

9. The portable convertible blast effects shield of claim 8, wherein said means for releasably securing said set of rings in the telescopically-collapsed configuration includes a plurality of click-lock devices between said rings.

10. A portable convertible ballistic shield for providing protected user mobility under weapons fire comprising:

a freestanding set of at least two telescoping cylindrical rings constructed of a composite fiber and matrix material to substantially inhibit blast effects from passing therethrough, said set of rings operably connected to each other to convert between a telescopically-collapsed configuration, and a telescopically-extended upright configuration forming an expanded inner volume and open at opposite ends thereof so that through one of the open ends the freestanding set of rings may be directly placed over and around an object or person to be shielded;

means for releaseably securing said set of rings to each other in the telescopically-extended upright configuration; and at least three rolling surfaces connected to and extending below said portable ballistic shield for enabling said user to roll said portable ballistic shield from inside the telescopically-extended upright configuration.

* * * * *